US005800279A

United States Patent [19]

Densberger et al.

[11] Patent Number: 5,800,279

[45] Date of Patent: Sep. 1, 1998

[54] DETACHABLE TRAINING SYSTEM FOR GOLF CLUBS

[75] Inventors: John A. Densberger, Livermore; Derek E. Decker, Discovery Bay, both of Calif.

[73] Assignee: ICIT, Livermore, Calif.

[21] Appl. No.: 879,339

[22] Filed: Jun. 20, 1997

Related U.S. Application Data

[63] Continuation-in-part of Ser. No. 489,546, Jun. 12, 1995, Pat. No. 5,640,777.

[51] Int. Cl.[6] ..... A63B 69/36

[52] U.S. Cl. ..... 473/220; 473/240; 473/254; 473/250

[58] Field of Search ..... 473/220, 240, 473/253, 254, 223, 224, 226, 228, 231, 233, 234, 238, 250

[56] References Cited

U.S. PATENT DOCUMENTS

| | | | |
|---|---|---|---|
| D. 233,535 | 11/1974 | Karban et al. | 473/240 X |
| 2,822,614 | 5/1958 | Susinno | 33/263 |
| 2,929,631 | 3/1960 | Gillon | 473/240 |
| 3,019,022 | 1/1962 | Ehmke | 33/263 X |
| 3,043,596 | 7/1962 | Ehmke | 473/240 |
| 3,170,698 | 2/1965 | Schoeffler et al. | 473/240 |
| 3,421,765 | 1/1969 | Scott | 473/240 |
| 3,507,500 | 4/1970 | Scott | 473/240 |
| 3,810,633 | 5/1974 | Scott, III | 473/240 |
| 3,912,277 | 10/1975 | Pelz | 473/236 |
| 4,367,877 | 1/1983 | Gibson et al. | 473/240 |
| 4,601,472 | 7/1986 | O'Flanagan | 473/240 |
| 5,195,749 | 3/1993 | Ugarte | 473/240 |
| 5,240,253 | 8/1993 | Cooper | 473/236 |
| 5,275,403 | 1/1994 | Jones | 473/240 |
| 5,640,777 | 6/1997 | Densberger et al. | 473/240 X |

*Primary Examiner*—George J. Marlo

[57] ABSTRACT

A detachable training system for golf clubs includes a golf club head having a top portion and a face portion. The system includes a removable training device with a base, the base formed to fit in a receiver on the club head. The system also includes a first removable plate formed to fit in the receiver on the club head when the removable training device is removed. In use, the removable training device is installed on the club during practice and is removed during actual golf rounds. The removable plate is installed on the club during golf rounds to provide similar weight, use and feel of the club head so the golfer can accurately replicate the strokes perfected during practice.

20 Claims, 8 Drawing Sheets

DETACHABLE TRAINING SYSTEM FOR GOLF CLUBS

RELATED APPLICATIONS

This is a continuation-in-part application based on U.S. patent application Ser. No. 08/489,546. Filed on Jun. 12, 1995, now U.S. Pat. No. 5,640,777, which is incorporated herein by reference for all purposes.

BACKGROUND OF THE INVENTION

1. Field of the Invention

The present invention relates to the game of golf. More specifically, the present invention relates to detachable golf training and alignment aids which improve accuracy.

2. Description of Related Art

A golf course generally has 18 holes spread over a landscaped area that customarily includes a number of hazards—water, rough, sand traps (also known as bunkers), and trees—that are designed to make the game more difficult. Difficulty is also increased by the varying distances among holes. Play on each hole is begun at the tee area, from which players "tee off" and "drive" the ball into the fairway or onto the green. At the end of the hole—which can vary in length from about 100 to 600 yards—is the putting green, which surrounds the actual hole, or "cup" into which the ball must be putted to complete the hole. Saint Andrews in Scotland, Augusta National in Georgia (site of the annual Masters tournament), and Pebble Beach in California have some of the most famous and difficult courses.

In the putting segment of the game of golf, the objective is to direct the ball across the putting green until it comes to rest in the hole or cup. The putting green is a smooth and closely cut grassy area surrounding the hole. An accurately hit golf ball will travel along a path to the hole. In the case where the path between the ball and hole contains a slope to one side or the other, the golfer will try to determine the proper target direction which will allow the ball (once struck) to follow a curved path to the hole.

Although the putting green is usually conditioned to provide an optimum surface over which to putt, a golfer's inability to accurately and consistently aim the ball can be a major source of undesirable "strokes" on the golfer's scorecard. When putting, it is very important that the face of the putter be placed at exactly a right angle in line to the target direction at the moment when the putter impacts the ball. Alignment of the putter adjacent to the ball in this manner is difficult when the ball rests even a short distance from the hole, since the golfer is usually unable to see the ball, club head, and target simultaneously. This problem also exists when using any type of golf club.

In general, a golfer attempts to ensure that club head alignment and motion are co-linear with the intended direction at the exact point of impact with the ball. Part of the appeal of the game of golf is the difficulty of mastering these strokes. Weekend golfers, who do not have the luxury of constant practice, have a difficult time consistently putting the ball accurately. Consistency can only be achieved by constant and repeated training so that the golfer can replicate the correct club head alignment and motion as needed during play. A number of patents have attempted to provide improvements in a golf club that would help a golfer achieve consistency in club head alignment and motion.

U.S. Pat. No. 3,421,765 is directed to a golf club including a sighting mirror for aligning the face of the golf club with a golf ball and the flag stick used on the putting green of a golf course. The device comprises a putter enabling the golfer to view the putter, golf ball, and a hole or flag stick simultaneously. The device includes a mirror or other reflective surface, attached to the head of the golf club in such a manner that, when the player places the club in position to putt the golf ball, the mirror will reflect an image of any object in the area in front of the face of the golf club, both horizontally and vertically in front of the face of the golf club so that the object can be seen by the golfer in his normal stance above the golf club.

U.S. Pat. No. 3,507,500 is directed to a putter which includes a mirror attachment that enables a golfer to view the putter, golf ball, and a hole or flag stick simultaneously. The device includes a mirror or other reflective surface, attached to the head of the putter in such a manner that, when the player places the putter in position to putt the golf ball, the mirror will reflect an image of any object in the area in front of the face of the putter.

U.S. Pat. No. 5,195,749 is directed to a golf club head which includes a front face with a negative inclination; a middle section inclined about 45° and a section which acts as a mirror with a view to lining up the stroke. A first object of the patent is to prevent the ball from being sliced or hooked. A second object of the patent is obtain a suitable line to aim the club with complete independence of the position and stance of the player.

Unfortunately, each of these devices can present erroneous feedback to the golfer due to the lack of an effective means for alignment between the club head and the golfer's eye. This erroneous feedback can lead to missed putts and the lack of any repeatable training benefit. Further these devices add undesirable mass unbalance about the center of the club face, resulting in unwanted movement of the "sweet spot" associated with a given club design. Still further, these devices are for practice only—they cannot be certified for United States Golf Association (USGA) use. The rules of golf dictate that most training and sighting aids can not be used during actual rounds of golf. Thus, it is desirable that any training aid used with a club be removable. Further, it is desired that the club without the training aid be substantially similar in weight, feel, and use as the club with the training aid so that any training benefit be directly applicable to use in actual rounds of golf.

U.S. Pat. No. 4,601,472 describes a sighting device for a putter and includes an eye aligning mirror having a horizontal reflective surface and a ball and target aligning mirror. The device is used for aligning the putting face of the blade square to a target path between a ball and target while aligning the eye of the player over the putter club head. The stated object of the patent is to provide a sighting device which may be attached to the blade of some types of putters without having to modify the putter blade so that the same putter may be used by a player in both practice and play under the rules of golf. The patent shows a limited means for alignment of the golfer's eye to the putter head, which is required for reliable feedback about the putter face. The mechanism used (a mirror laying flat on top of the putter so the golfer may see his eye in the reflection) fails in a number of ways.

For example, this approach defines a single point in space—the point where the golfer's eye is positioned directly above the mirror. This does not allow the golfer to position his head behind or ahead of the club. This may be uncomfortable, awkward, or unnatural for some players. Further, this approach increases the likelihood of seeing the sun reflected in the mirror which poses an optical hazard of temporary blindness or after images that impair vision. Additionally, the putter head will tilt out of alignment to the golfer's eye during a swing except in the unlikely event where the swing is on a circular arc centered on the golfer's eye. The design is further limited to a given style or type of putter head. The putter head striking surface is, unfortunately, reduced to approximately twenty-five percent of the original putter head striking surface. In addition, due to the small size of the mirror and its distance to the eye, the golfer may get confused about which eye sees which, e.g., right seeing right, right seeing left, and right seeing left while simultaneously left seeing right. Finally, the club with the mirror attached does not have the same weight, use, and feel as the club without the mirror (e.g., the striking surface is changed dramatically as is the weight of the club).

Accordingly, it is desirable to provide a golf training system which allows a golfer to practice with the training aid, and play without the training aid. Preferably, the weight, use, and feel of the club without the aid is similar to the weight, use, and feel of the club with the aid so that a golfer can accurately replicate the strokes perfected with the aid. With the training aid, it is desirable that visual feedback is provided to the golfer which ensures that the alignment of the club head be co-linear with the intended direction at the point of impact. Preferably, the visual feedback allows the golfer to align along a plane, or even multiple planes, rather than just a single point in space. It is also desirable to provide a golf club that includes a means for insuring that the position of the club head with respect to the golfer's view remain within a prescribed plane, both before and during the putting stroke. It would also be beneficial if the alignment of the golf club to the intended target included a means for on-axis viewing of the golf ball and target in a properly balanced club. Additionally, it would be helpful if the golf club include visual feedback to assist and verify a straight swing of the club head in the plane that includes the intended target direction. It is further desirable that other training devices be provided which are interchangeable on the club head to provide different training benefits as needed. Quite surprisingly, embodiments of the present invention provide these and other advantages and benefits.

SUMMARY OF THE INVENTION

Accordingly, in one embodiment of the present invention, a golf club training system is described for a golf club head having a top portion and a face portion. The system includes a removable training device with a base, the base formed to fit in a receiver formed on the club head. The system also includes a first removable plate formed to fit in the receiver of the club head when the removable training device is removed. In use, the removable training device is installed on the club during practice and is removed during actual golf rounds. The removable plate is installed on the club during golf rounds to provide similar weight, use and feel of the club head so the golfer can accurately replicate the strokes perfected during practice. It is believed that clubs implemented in accordance with features of the present invention with the removable plate installed are compliant with USGA rules. Club heads used in embodiments of the present invention may be formed to have an open architecture—a design providing a common platform for attaching various training aids and other inserts such as weights, etc.

In one specific embodiment of the present invention, the removable training device is a parallax alignment device. In another embodiment, the removable training device is a pointing device including, e.g., a laser source, optics, and a power source.

Embodiments of the invention also may provide additional removable plates having different masses selected to alter a swing weight of the club, thereby allowing a golfer to alter the feel and swing characteristics of a given club without the expense of replacing the club.

The result is a training kit and system which permit a golfer to perfect his alignment and swing during practice and which allows the golfer to use the same club during actual rounds of golf. The training aid is quickly and easily replaced with a removable plate allowing the club to comply with the rules of golf.

According to other embodiments of the present invention, a compound alignment system is provided which may be attached to the head of a club. The alignment system includes two independent alignment systems which may share common parts such as a turning mirror. The first alignment system is referred to as a parallax correction alignment system as it removes visual parallax to properly align the golfer's eye to the club head. The second alignment system is referred to as the sighting alignment system because the golfer sets his sights on a target while looking into the turning mirror. When used together, these alignment systems allow the golfer to line up a stroke, such as a putt, much more accurately than would be possible without this visual feedback. Once aligned, an opportunity exists to recognize and learn what a true alignment looks and feels like.

In one example, a putter head has a forward striking face for impacting a ball, and has a rear upper portion which holds a reflecting surface that is angled to present a view of the golf ball and the target upon sighting alignment. The mirror usually has a protective glass or plastic layer above the reflecting surface. This transparent spacer with a thin line (co-planar with the surface normal of the striking face) painted on the top surface constitutes an embodiment of the parallax correction alignment system. A reflection of the line is visible from the reflective surface. For proper parallax correction alignment, the line on the top of the transparent spacer obscures the reflected line in the golfer's view. While maintaining parallax correction alignment, the club head is translated until the golf ball is aligned evenly about the overlaid lines to center the ball on the striking face and then sight the target in the reflection viewed by the golfer. When this alignment is maintained during the golfer's stroke, the directional accuracy is improved dramatically.

An advantage of this approach over existing putters and other golf clubs is the elimination or reduction of initial set-up error. Trial and error experimentation to interpret or adjust for the off-axis view is eliminated. The player's confidence will ultimately be improved through the reduction in alignment uncertainty caused by improper or questionable set-up. Additionally, proper swing motion and the development of correct muscle memory for consistent golf strokes is possible when the alignment described above is done in two or more locations such as near the ball and when the putter head is several inches or more distant from the ball before it is struck. Muscle memory is reinforced by observing that one can swing back and return to the ball and still be aligned. Accuracy gain is a welcome form of feedback that gives confidence to any golfer.

Set-up error is eliminated or reduced through the iterative alignment procedure which is visual and easy to learn. The procedure first utilizes the parallax correction alignment system to ensure accurate positioning of the golfer's eye relative to the club head. Next, the sighting alignment system provides an on-axis view for club head, ball and target alignment. Hence, the article is a new training aid, as well as a club that can be used during an actual golf game while complying with the rules of golf.

A further understanding of the nature and advantages of the inventions herein may be realized by reference to the remaining portions of the specification and the attached drawings.

DETAILED DESCRIPTION

Figure 1:
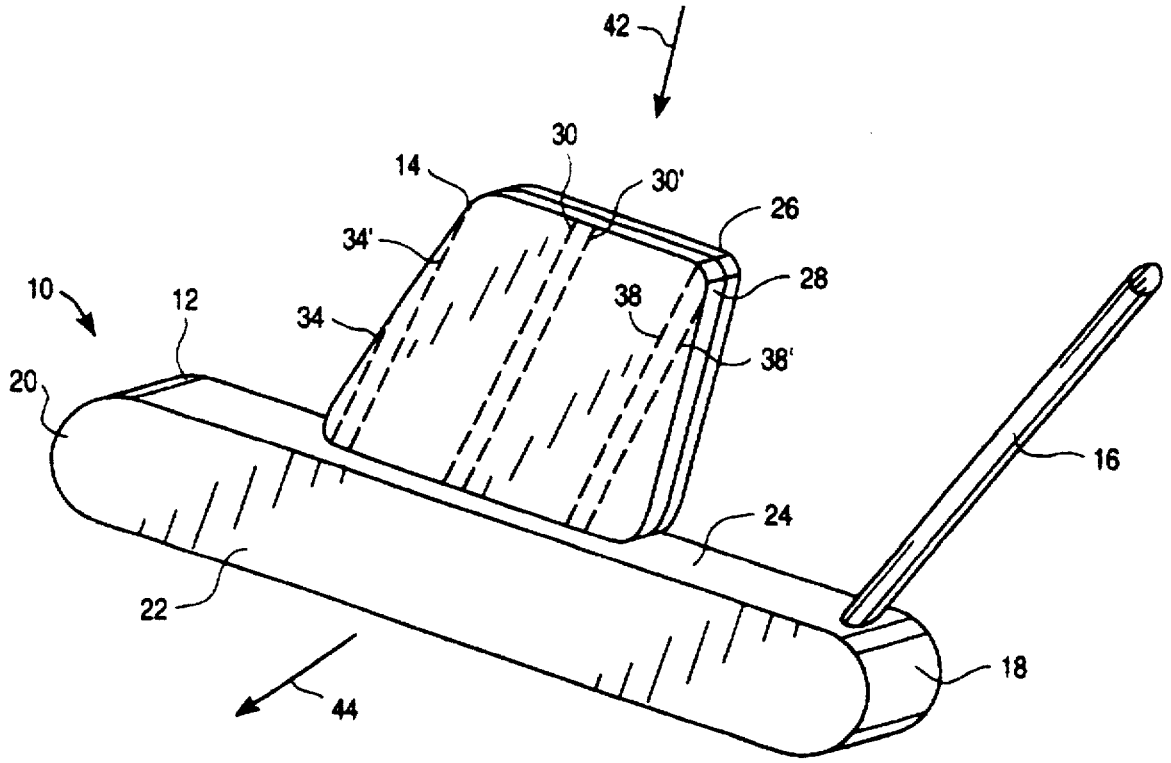
FIG. 1 is a perspective view of a training system according to one embodiment of the present invention.

Features of embodiments of the present invention will now be described by first referring to FIG. 1, where one embodiment of a training system 10 is shown. In this embodiment, a golf club head 12 is shown with a removable training device mounted thereon. In this embodiment, the removable training device is a removable parallax correction and sighting device 14. As discussed herein, and merely for the sake of providing an example of one preferred embodiment, golf club head 12 is a putter head; however, as will become apparent to those skilled in the art, features of the present invention may be implemented with other types of golf club heads (e.g., irons or chippers). Further, although a club head of a specific shape is shown herein as an example, embodiments of the present invention may be implemented using substantially any club head shape and design.

Golf club head 12 includes a heel portion 18, a toe portion 20, a face portion 22, and a top surface 24. Golf club head 12 is manipulated by a golfer via a shaft 16. In use, a golfer (not shown) grips shaft 16 and stands above the golf club head 12, sighting down on the golf club head 12 along sight line 42. The golfer manipulates golf club head 12 to strike a ball (not shown) along a target line 44 (e.g., towards a hole, or towards another point on a green in an example where the green is not level).

Removable parallax correction and sighting device 14 is attached, in one specific embodiment, to the golf club head 12 on top surface 24. A surface normal of removable parallax correction and sighting device 14 and a surface normal of face portion 22 are co-planar to ensure that sighting and parallax correction are provided along the correct plane in relation to face portion 22. Removable parallax correction and sighting device 14, in this specific embodiment, is formed from a reflective layer 26 and a transparent layer 28. In a currently-preferred embodiment, transparent layer 28 is formed from a durable crack resistant material such as acrylic, although those skilled in the art will realize that other transparent materials may also be used, such as glass, polycarbonate, or the like. Preferably, reflective layer 26 has sufficient thickness to provide a parallax effect as will be discussed below. One-quarter (¼) inch acrylic material has been found to provide desirable results. Reflective layer 26, in a currently-preferred embodiment, is formed from a thin and durable reflective material such as a thin aluminized backing. Other reflective materials may be bonded, deposited, or otherwise disposed on a surface of transparent layer 28. Preferably, removable parallax correction and sighting device 14 is shaped symmetrically so the weight of the device is evenly distributed about the center of the club head.

In the specific embodiment shown, the removable parallax correction and sighting device 14 includes dashed, or broken, sighting lines 30, 34, and 38 on a top surface of transparent layer 28. These sighting lines may be etched, inked, silkscreened, hotstamped or otherwise deposited or formed on transparent layer 28. As will be described more fully below, these sighting lines provide parallax correction to visually indicate to the golfer whether he is properly aligned. The golfer may use sighting line 30 as the primary sighting line, with lines 34 and 38 used to provide additional (e.g., coarse or fine) parallax correction information. The parallax correction provided by these sighting lines enable a golfer to more accurately strike a ball with face portion 22 of golf club head 12.

In the specific embodiment shown, sighting lines 34, 38 are secondary lines, while sighting line 30 is the primary sighting line positioned along the axis at which the golfer should strike the ball. These lines operate as follows. Parallax correction and sighting device 14 is centered on top face 24 of golf club head 12 so that sighting line 30 is directly above the center plane of golf club head 12. A golfer using the club stands above golf club head 12 and sights down along sighting line 42. If the golfer's eye is in the plane of sighting line 30, he sees a reflected line 30' co-linearly disposed along sighting line 30. Because parallax correction and sighting device 14 is angled (e.g., at about 45° from horizontal as will be discussed in conjunction with FIG. 2 below), sighting line 30 and reflected line 30' appear to form a single solid line if the golfer's head is properly positioned above the center of the club face.

Similarly, secondary sighting lines 34 and 38 create reflected lines 34' and 38' respectively. Because these secondary sighting lines 34, 38 are positioned a distance apart from sighting line 30, the reflected images 34', 38' which appear from secondary sighting lines 34, 38 appear to form a jagged or zig-zag shape. Small movements of the golfer's eye outside of a plane in which parallax is corrected (e.g., the plane defined by sighting line 30 and its reflected line 30') will greatly alter the shape of these secondary lines, so that the golfer can rely on these images, where desired, to correct his position relative to the club head. Embodiments of the present invention may be formed without these secondary sighting lines, or with varying numbers or shapes of the lines.

Figure 2:
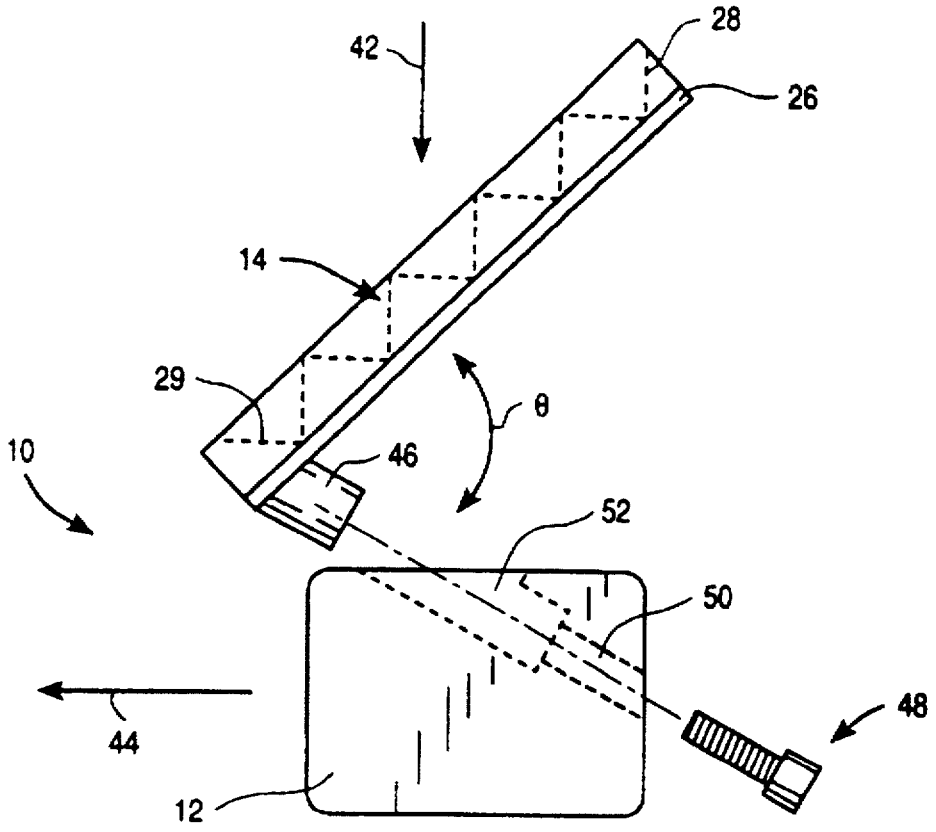
FIG. 2 is a side cut-away view of the training system of FIG. 1.

Referring now to FIG. 2, a side view of training system 10 is shown. Parallax correction and sighting device 14 may be removably attached to golf club head 12 using a base portion 46 which inserts into receiver 52. Base portion 46 may be formed of any rigid material, such as metal, polycarbide, ABS plastic or the like. Base portion may be integrally formed with or securely bonded or affixed to removable parallax correction and sighting device 14.

Receiver 52, as shown in this specific embodiment, may be formed to accommodate a bottom portion of parallax correction and sighting device 14 as well, thereby providing a firm seat for that device. Receiver 52 may be machined, injection-molded, or otherwise formed in club head using techniques known in the art. In one embodiment, base portion 46 and receiver 52 are formed to provide a tight interference fit so that parallax correction and sighting device 14 may be securely mounted on golf club head 12 without the use of any tools or hardware. In one embodiment, an access opening 50 is formed to permit the parallax correction and sighting device 14 to be unseated from receiver 52 using, e.g., a golf tee or similar object. In another embodiment, access opening 50 is formed to receive a fastener device 48, and base portion 46 is shaped to receive fastener device 48. Fastener device 48 may be, e.g., a screw with a knurled head for easy removal, or other fasteners known to those skilled in the art.

Parallax correction and sighting device 14 is mounted on golf club head 12 at an angle $\phi$. In a currently preferred embodiment, angle $\phi$ is 45°+/−5°. This angle $\phi$ is selected to allow a golfer to sight down along sight line 42 into the reflective layer 26 of parallax correction and sighting device 14 and see the golf ball and the target line (e.g., the hole at which he is aiming, assuming that the green is level). An angle $\phi$ equal to about 45°+/−5° has been found to provide the best field of view of the target. This allows the golfer to accurately aim sighting line 30 at the target. The angle also allows sighting line 30 to reflect off reflective surface 26 as shown (item 29) to produce reflected line 30'. This reflection, with an incident angle equal to angle $\phi$, allows the dashed portions of sighting line 30 and the dashed portions of reflected line 30' to combine and form an apparent single solid line when properly viewed along the plane where parallax is corrected (for example, along sight line 42 which is in the plane where parallax is corrected). The angle provides a similar effect (with a dashed or zig-zag appearance when properly sighted) for secondary sighting lines 34, 38 and their respective reflected lines 34', 38'.

In an alternative embodiment, sighting line 30 may be replaced with a slit etched in reflective surface 26 and/or in transparent layer 28. In this embodiment, a correctly positioned golfer viewing in the plane where parallax is corrected(e.g., sighting along sight line 42) will see a line having a contrast when looking in the plane of the etched slit. Etching the slit through the transparent layer and the reflective surface will greatly enhance the sensitivity of parallax correction. The width of the slit etched will also contribute to the parallax sensitivity.

In yet another alternative embodiment (not shown), a portion of coarse tuning line 30 may be replaced with a reflective strip positioned along a top surface of the transparent material. The reflective strip will propagate a reflected image from a base of the parallax device to an upper portion of the parallax device. This increases sensitivity by increasing the effective distance between a line on a top surface near the top of the parallax correction and sighting device 14, and a multireflected image of a line on a surface near the bottom of the parallax correction and sighting device 14 which then appears at the top of the device 14.

The result of each of these removable parallax correction and sighting devices is a training aid which permits a golfer to properly align his head in a plane over the club head and ball while also looking into the reflective surface to sight at the target. The device provides effective and accurate alignment between the golfer's eye and the club head, without erroneous feedback. Used properly and repeatedly, this training aid permits a golfer to develop a correct feel for position and alignment which can result in drastically improved scores on the golf course.

Figure 3:
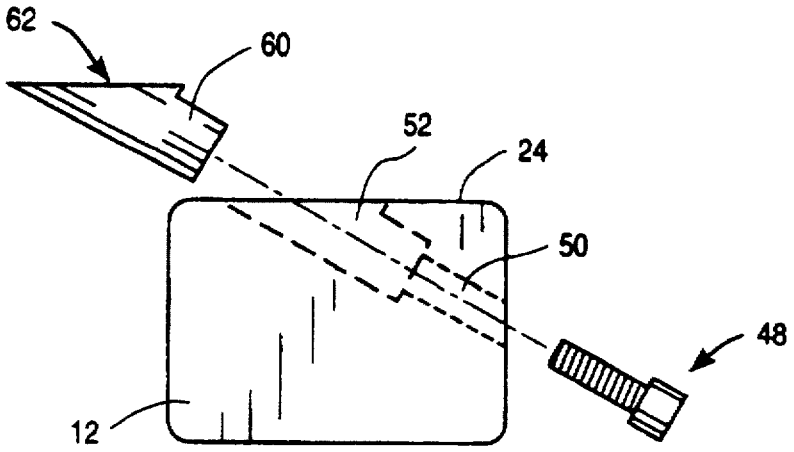
FIG. 3 is a side cut-away view of the training system of FIG. 1 with a removable plate installed.

Embodiments of the present invention permit the same golf club head 12 to be used without the training aid 14. This is beneficial as the rules of golf generally prohibit the use of sighting and alignment aids in actual play. Referring now to FIG. 3, an embodiment of a golf club head 12 and a removable insert device 60 according to the present invention is shown. When training aid 14 is removed from golf club head 12, an open receiver 52 remains. Also, the weight and feel of the golf club head 12 are altered when training aid 14 is removed. This weight is compensated for by inserting removable insert device 60 into receiver 52. Removable insert device 60 is, in one preferred embodiment, formed with a flat top surface 62. When removable insert device 60 is inserted into receiver 52, the flat top surface 62 of the device is flush with the top surface 24 of golf club head 12.

Preferably, removable insert device 60 is formed with a mass approximating that of the removable training aid 14 which the golfer normally uses, so the golf club head has the same or similar swing weight as with the training aid. In alternative embodiments, a training kit may be provided with several removable insert devices 60, each having a different mass to provide different, easily altered, swing weights for a given golf club head 12. Additionally, removable insert device 60 may be used to alter a swing weight of a club for current playing conditions, e.g., to add more mass to the club head to compensate for wet or slow greens, or to remove mass from the club head to compensate for dry or fast greens. This permits a player to consistently use the same swing despite differing conditions. Further still, removable training aid 14 may be manufactured with differing masses to allow a golfer to choose a favorite swing weight, again allowing consistent transition between practice and play.

In one specific embodiment, removable insert device 60 and receiver 52 are formed to have a firm interference fit so that the device remains in place without the use of attachment devices. In another specific embodiment, an access opening 50 is provided. This access opening may be used to unseat removable insert device using, e.g., a golf tee or similar object. In yet another specific embodiment, a fastening device 48 may be used to secure removable insert device 60 within receiver 52.

Figure 4:
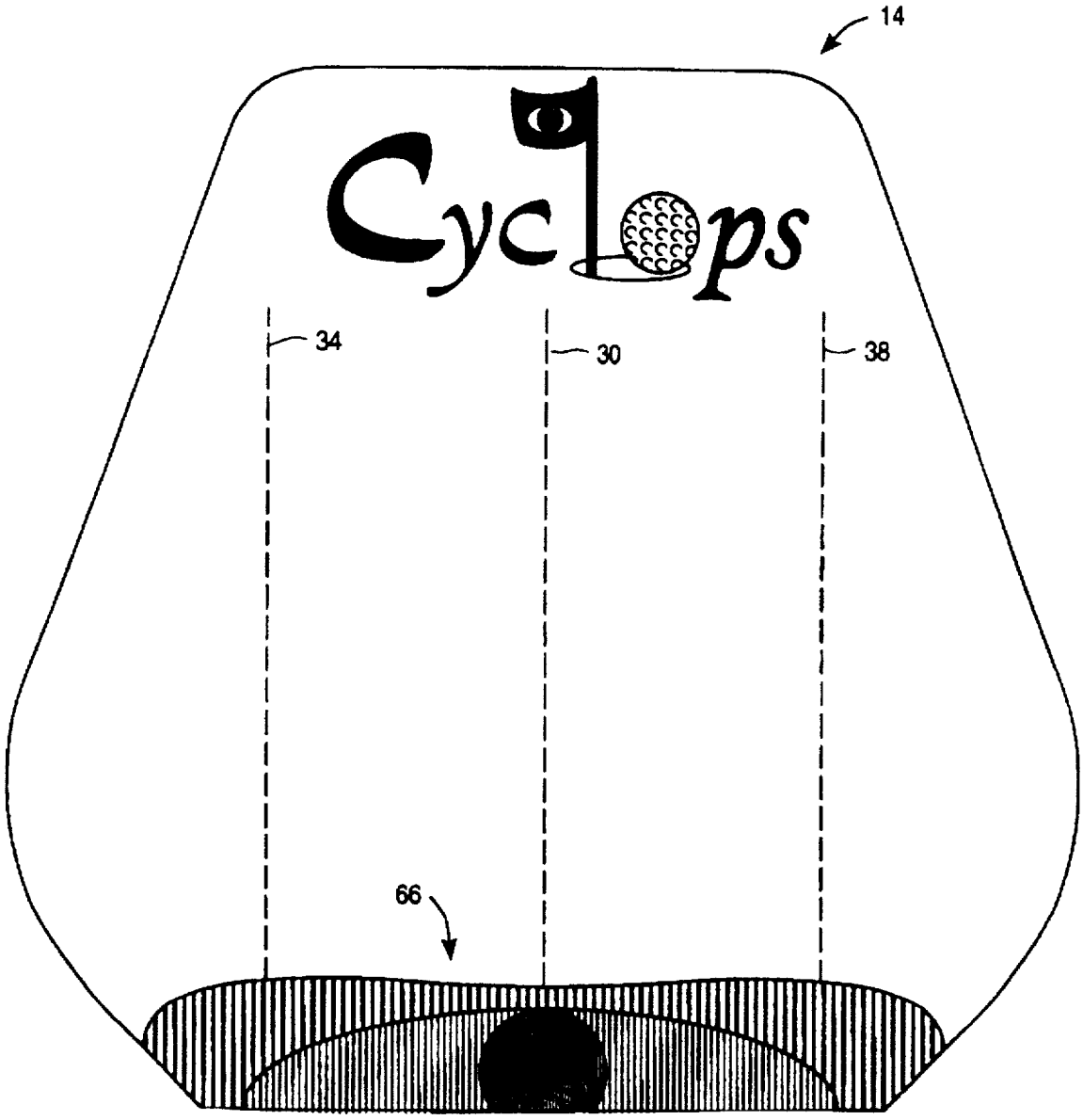
FIG. 4 is a front view of a training aid according to another embodiment of the present invention.

Referring now to FIG. 4, another embodiment of a removable parallax correction and sighting device 14 is shown. In this embodiment, coarse tuning line 30, and fine tuning lines 34, 38 may be augmented (or partially or wholly replaced) with a möire interferometry pattern 66. Möire interferometry pattern 66 consists of a plurality of lines inked, silkscreened, etched, hotstamped or otherwise disposed on a top surface of a transparent layer 28 of parallax correction and sighting device 14. Pattern 66 is selected to provide visual feedback to the golfer when his eyes are correctly sighting down sight line 42. Other patterns may also be used to provide visual parallax correction feedback to the golfer.

Figure 5A:
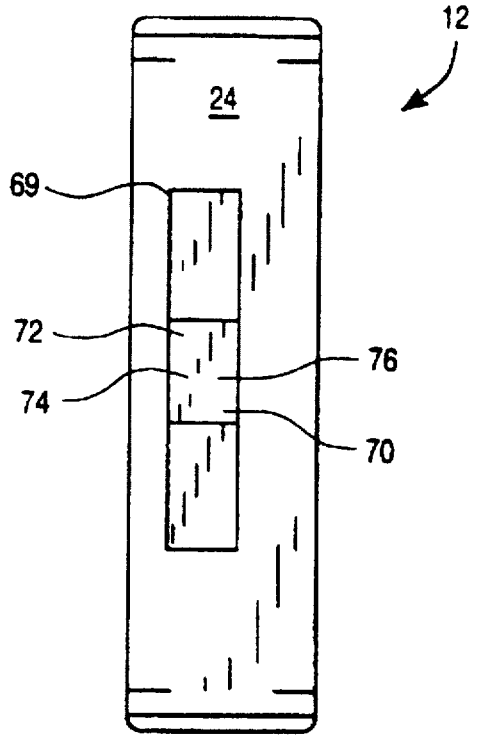
FIGS. 5A–C depicts a training aid according to another embodiment of the present invention.
Figure 5B:
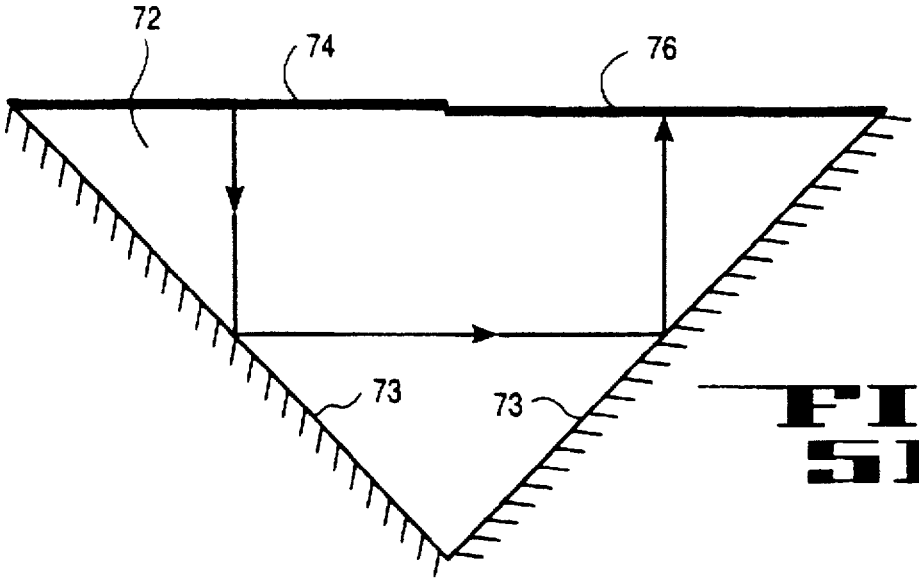
Figure 5C:
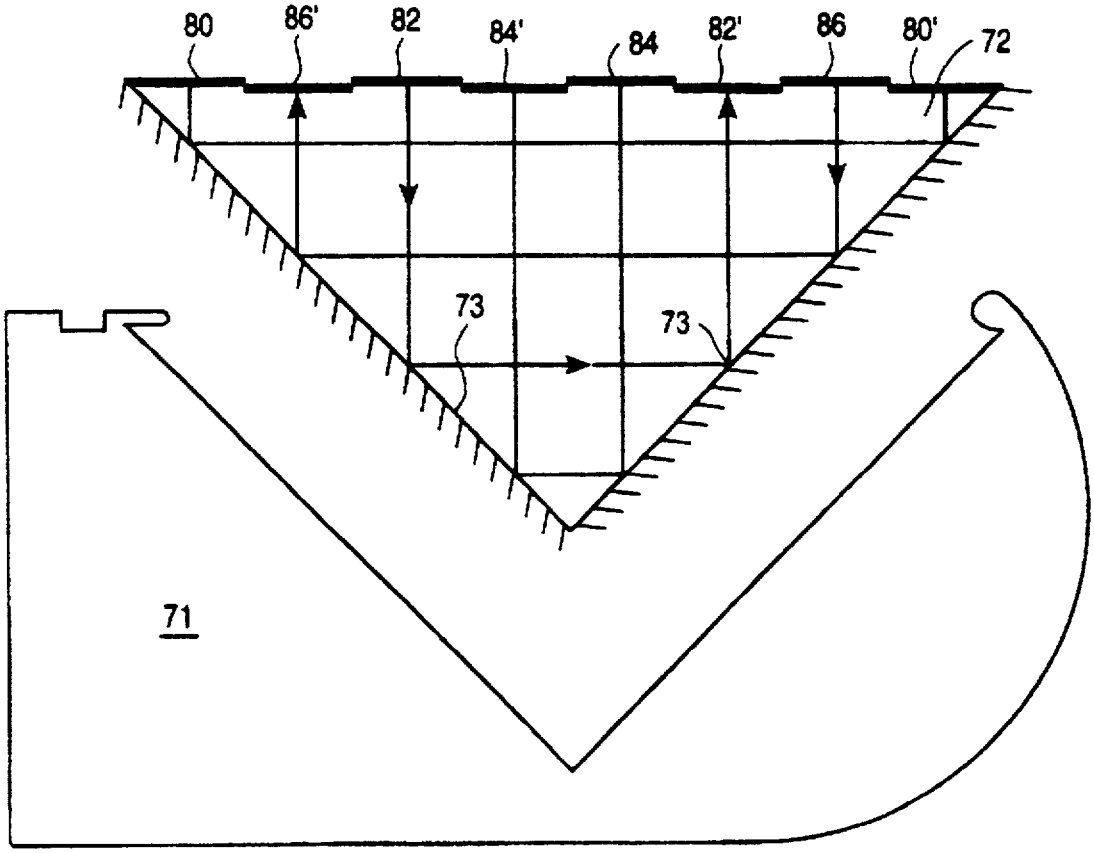

Another embodiment of a training aid which may be installed and used in conjunction with golf club head 12 is shown in FIG. 5. Referring first to FIG. 5A, where a top view of a parallax correction aid 70 is shown installed in a receiver 69 formed in a top surface of golf club head 12. The receiver may be the same shape and size as receiver 52 described in conjunction with FIGS. 1–3. Alternatively, parallax correction aid may be installed into a retrofit receiver 71 such as the one shown in FIG. 5C. Retrofit receiver 71 is, in a currently-preferred embodiment, specially formed to fit in existing club head designs. For example, retrofit receiver 71 may be formed and sized to fit in a cavity of a cavity-backed putter design such as designs available from Ping®. Use of retrofit receivers permits use of parallax correction aid 70 with virtually any club design. Retrofit receiver 71 may be glued, bonded, taped, or otherwise coupled to a club head.

Parallax correction aid 70 includes a transparent viewing portion 72 positioned to be at a center of the golf club 12. Transparent viewing portion 72 may be formed from any transparent material, such as acrylic or the like. Transparent viewing portion 72 is formed on top of a reflective surface 73 (see FIGS. 5B or C). At least a first sighting line 74 is formed along a top surface of transparent viewing portion 72. A triangular cross-section of transparent viewing portion 72 (see FIG. 5B) serves to produce a reflected sighting line 76. When a golfer positions his eyes so that he is viewing the golf club along sight line 42, the reflected sighting line 76 will align with first sighting line 74. Movement of the golfer's head away from a plane where parallax is corrected (e.g., in a direction towards or away from the heel or toe from sight line 42) will result in movement of reflected sighting line 76 so that reflected sighting line 76 is no longer co-linear with first sighting line 74. For example, the lines will no longer be co-linear when the golfer moves his head away from the plane of the center line, e.g., towards the heel or towards the toe of the club head. This visual feedback allows a golfer to properly position his head in the plane where parallax is corrected (e.g., a plane including the target line) above the golf club head, helping to ensure a more accurate shot.

A second embodiment is shown in FIG. 5C, where multiple sighting lines 80–86 are shown formed on a surface of transparent viewing portion 72. A corresponding number reflected sighting lines 80'–86' are created by the reflective surface 73. Again, when the golfer is properly positioned, the sighting lines and reflected sighting lines will align to form a substantially solid and straight line. Other variations including differing numbers of sighting lines may also be implemented. Further, reflective surface 73 may be formed of aluminized or other reflective materials or may also be formed using total internal reflection techniques. Still other variations include treating the device as a prism and rotating the prism, e.g., 45° to provide another embodiment of parallax correction device.

Figure 6:
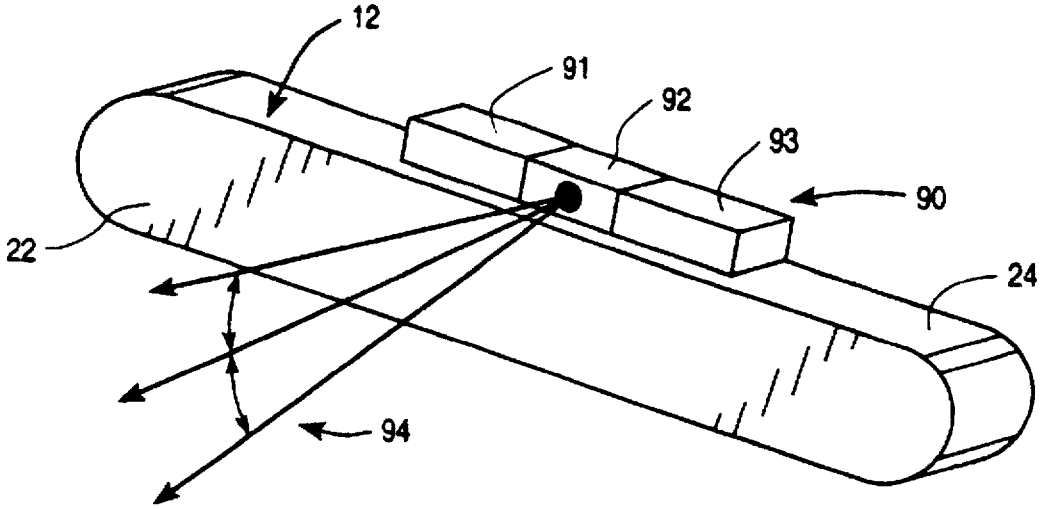
FIG. 6 depicts a pointing aid according to another embodiment of the present invention.

Embodiments of the present invention also support other removable training aids which may be mounted in a receiver 52 formed in a club head 12. For example, referring now to FIG. 6, a pointing device 90 is shown which includes a laser source 91, optics 92, and a power source 93. Those skilled in the art will recognize that the physical configuration shown in FIG. 6 is merely an example, and that other configurations may be used. Pointing device 90 may be formed to direct a coherent beam of light 94 along a target path, allowing a golfer to accurately aim in practice. Further, optics 92 of pointing device 90 may include imaging devices positioned to form a fan, plane, or other pattern of light. As with other training devices according to embodiments of the invention, pointing device 90 may be secured to club head 12 with an interference fit or using a fastening device 48.

Figure 7A:
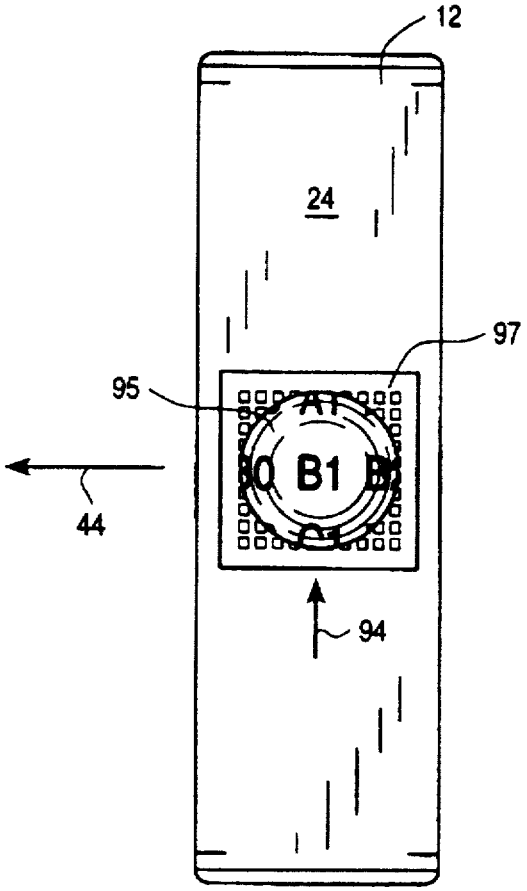
FIGS. 7A–B depicts a view locator according to another embodiment of the present invention.

A further training aid is shown in FIG. 7, where a view locator 94 is shown which includes imaging optics 95, a transparent spacer 96, and an information matrix 97. Imaging optics 95 may include, for example, a lens or diffractive optic device. View locator 94 may be mounted in receiver 52 of club head 12, may be permanently mounted on a club, or may be temporarily attached to a club using, e.g., tape or some other method of bonding known to those skilled in the art, thereby permitting club heads to be retrofitted to enjoy the advantages provided with use of view locator 94.

Figure 7B:
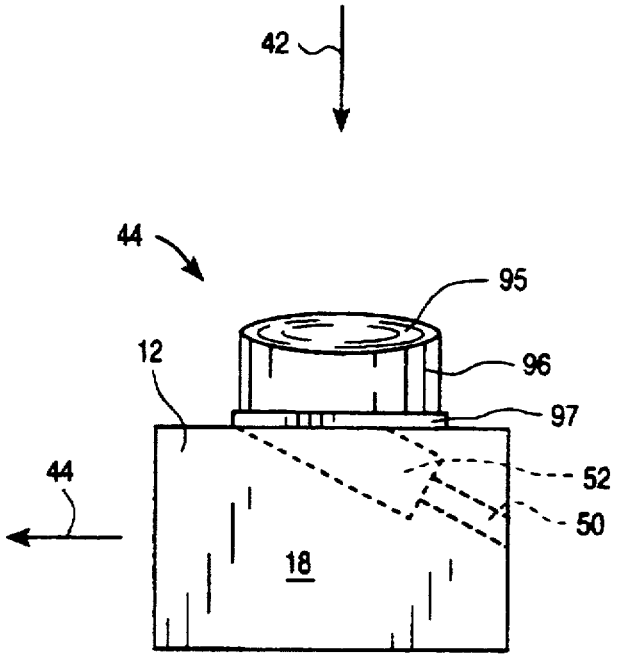

In use, view locator 94 is positioned above a center point of a club head 12 so that when a golfer sights along sight line 42, a specific piece of information in information matrix 97 is clearly displayed by imaging optics 95. For example, as shown in FIG. 7B, the information matrix 97 consists of a matrix of identifiable indicia, such as alpha-numeric characters placed on, e.g., a microfiche. In a currently-preferred embodiment, a matrix of alpha-numeric characters (A1 . . . Ai) by (N1 . . . Ni) is provided on a microfiche. The size of imaging optics 95 and the information in information matrix 97 are selected such that only one piece of information from the matrix is displayed at a time (e.g., a character from a single row and column of the matrix). In a currently-preferred embodiment, a row such as B1 . . . B5, is positioned along a parallax corrected plane, while columns (e.g., A2 . . . E2) are positioned in planes perpendicular to the parallax corrected plane.

This allows a golfer to correct his head position in multiple planes. For example, a golfer may find that he is most accurate when his head is positioned a certain distance behind the ball and may have found that when the column ending in the number "3" is displayed in imaging optics 95 he is most accurate. The golfer may also determine that he is most accurate when his sight line is slightly over center, e.g., when the row containing the letter "B" is displayed. This exemplary golfer will therefore try to position himself such that matrix entry "B3" is displayed in imaging optics 95. Thus, when setting up, e.g., a putt, a golfer can establish the club and his head in the position in which he is most accurate. Through repetition and practice, the golfer may find that he can reliably assess his position over the ball without use of the view locator 94. In this case, embodiments of the present invention permit the golfer to remove the view locator from the club and replace it with a removable insert as shown in, e.g., FIG. 3. In other embodiments, view locators may be permanently coupled to a club head for use during actual play.

Those skilled in the art, upon reading this disclosure, will recognize that other training aids may be implemented using techniques of the present invention, permitting golfers to utilize a single club for practice and play, and even competition. It will also become apparent that each of the training devices described herein could be used in tandem. For example, the removable parallax correction and sighting device of FIG. 1 may be combined with the view locator of FIG. 7 to provide further feedback to a golfer.

Figure 8:
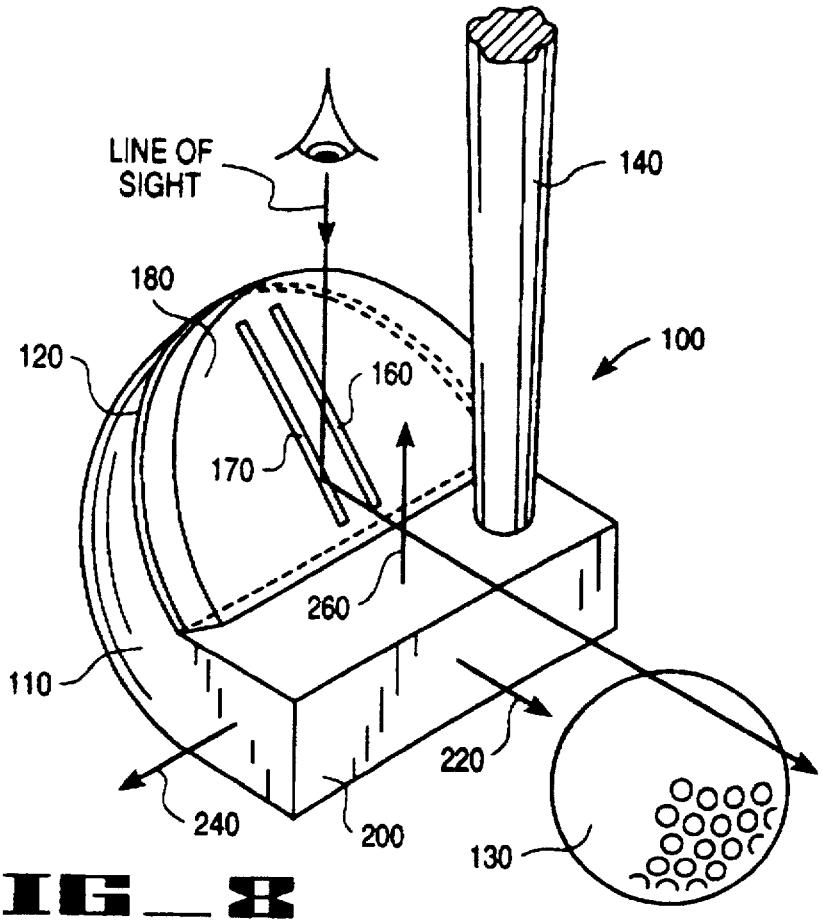
FIG. 8 is a perspective view of a training system according to another embodiment of the present invention.
Figure 9:
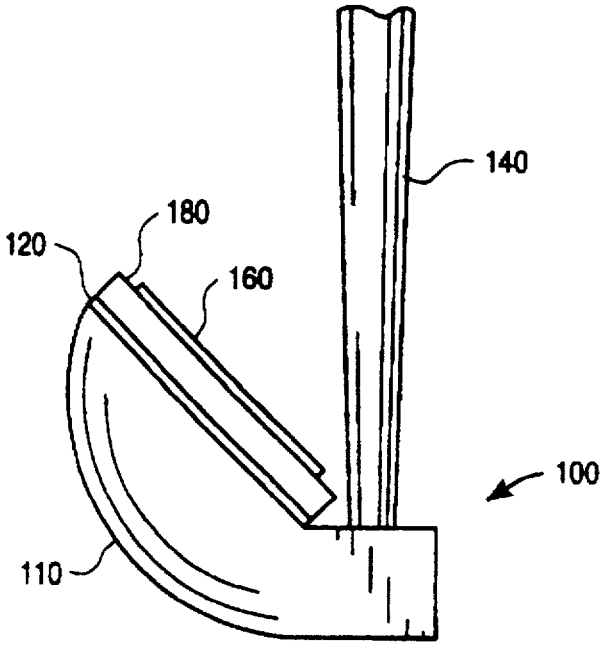
FIG. 9 is a side view of the training system of FIG. 8.
Figure 10:
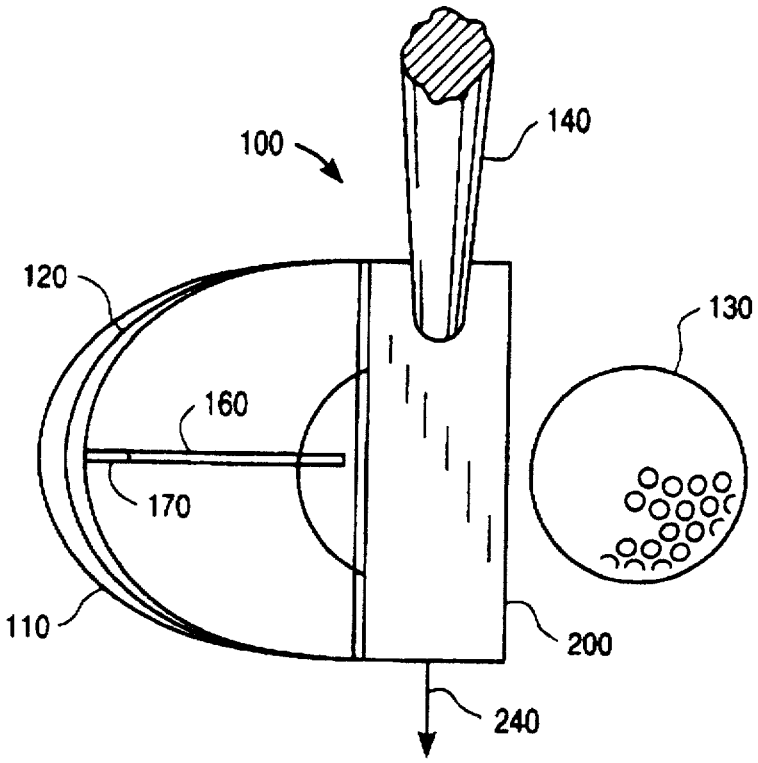
FIG. 10 is a top view of the training system of FIG. 8.

Referring now to FIGS. 8–10, several alternative embodiments of parallax correction devices according to embodiments of the invention will now be described. FIG. 8 shows a perspective view of putter head 100 with rear portion 110 which is upwardly angled at about 45° and has a reflective surface 120 attached to the top thereof. A transparent spacer 180 is either attached to the top of reflective surface 20 or the reflective coating 120 is applied to the bottom of the transparent spacer layer 180. One embodiment of a parallax correction alignment system comprises a solid, dot, dashed or patterned line 160 incorporated on or embedded in to the transparent spacer layer 180 in such a way that it is co-planar with the surface normal of the striking face 200. Let the surface normal be defined as a line passing through the center of the striking face 200 and being perpendicular to a planar striking face 200, or at least horizontally perpendicular to a curved or tilted striking face 200. Forward axis 220 illustrates such a surface normal. Horizontal axis 240 and vertical axis 260 are also shown. Line 160 may have a top color that is different from a bottom color to discriminate reflected line 170 from the top line 160, to ensure that the user's eye to the club is in the proper plane, as the user holds shaft 140 in the normal putting stance. While holding the putter in the normal putting stance, line 160 is aligned when viewed to be co-planar to reflected line 170, through golf ball 130 and to the target (not shown).

FIG. 9 shows a side view of the putter of FIG. 8. Upwardly angled rear portion 110 of putter head 100 has reflective surface 120 attached thereto. Transparent spacer 180 is attached to the top of reflective surface 120. Line 160 is attached to the top of or embedded into the transparent spacer layer 180. Shaft 140 upwardly extends from a portion of the putter head 100. Reflective mirror surface 120 and transparent spacer layer 180 angle above a hitting surface (about 45°) so as to allow the user to sight down through line 160 and 170, and ball 130 to the intended target.

Figure 11:
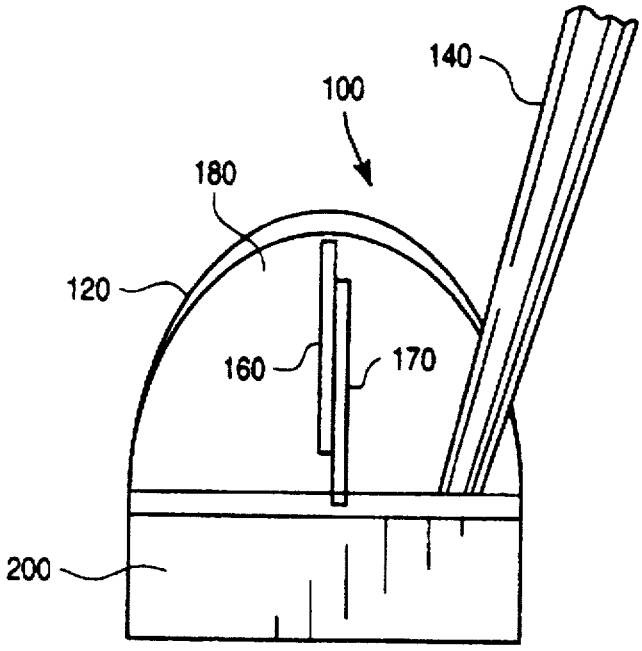
FIG. 11 is a front view of the training system of FIG. 8.

FIG. 10 is a top view of putter head 100, reflective surface 120, spacer 180, club face 200, golf ball 130, and shaft 140. The parallax correction alignment system comprises line 160 and reflected line 170 and a transparent space between them. This is approximately the view as seen by a player in the normal putting stance. The reflection of golf ball 130 is shown in the reflective surface 120. A target, such as a flag stick in a hole of a putting green, is not illustrated in reflective surface 120. The overlap of lines 160 and 170 show parallax correction alignment is obtained but the putter head 100 should be translated along horizontal axis 240 to better center the golf ball 130 on the striking face 200 as shown by lines 160 and 170 not equally dividing the image of golf ball 130 in the reflective surface 120. FIG. 11 shows a front view of putter head 100, reflective surface 120, spacer 180, club face 200, and shaft 140. The parallax correction alignment system comprises line 160 and reflected line 170 and a transparent space between them. FIG. 10 shows that reflected line 170 is slightly out of alignment with line 160.

As indicated in FIGS. 8–10, the parallax correction alignment system may include a first line and a second line, where the first and second lines are located in the plane defined by the surface normal of the turning mirror and the horizontal component of the surface normal of the striking face of the golf club. The first line is then located between a user's view and the second line, where the first and second lines are separated along an optical axis extending from the user's view to the second line. The parallax correction alignment system is properly aligned when the first and second lines overlap in the user's view in the defined plane. The second line may simply be a reflection of the first line in the turning mirror if the first line extends across the mirror separated by a small distance. The reflected second line may be seen when the user's view is out of the defined plane.

Operation of the device of an embodiment of the present invention requires two different alignment procedures to ensure a true on-axis view of the target. The first alignment procedure is to align the golfer's eye to the proper plane to view an image in the reflective surface 120 by means of the parallax correction alignment system, which in one embodiment contains line 160, reflected line 170, and a transparent spacer between them. The parallax correction alignment system provides real-time visual feedback in which the golfer rotates the putter head 100 about the forward axis 220 to eliminate or minimize parallax (i.e., when line 160 overlaps reflected line 170). Alternatively, the golfer may translate his/her eye along horizontal axis 240 until overlap of lines 160 and 170 indicates his/her eye is in the proper viewing plane. The alignment line 160 may incorporate a line or pattern which runs down the center from top to bottom of the transparent spacer layer 180, just above reflective surface 120, and could use different colors for the top and bottom surface of the line or pattern 160. The user views the top surface of the line or pattern 160 and the bottom surface of the line or pattern 170 as it is reflected in the reflective surface 120. When the user's eye is in the proper plane, the line 160 and the reflected line 170 will overlap one another and only the top color will be visible. If the user is not in the proper plane, then all or a portion of the reflected line adjacent to either side of the top line will be observed, indicating an off-axis or parallax view which exposes a different color on the bottom side.

The second alignment procedure is then to align the club face to the ball and target. This alignment is accomplished by twisting about vertical axis 260 and if necessary, tipping about horizontal axis 240 to observe through reflective surface 120 the golf ball 130 in line with the target. Once this second alignment is accomplished, the user has a view similar to the view of a billiards player viewing the cue stick in alignment with the cue ball and target or target direction.

The next step is for the user to iterate alignment procedures one and two to ensure only one line is visible in the reflective surface 120 and also that the club hitting surface, the ball, and intended target are in correct sighting alignment. This step is accomplished by the user changing their focus from the parallax alignment system on putter head 100 (in this case line 160) to the images in reflective surface 120, until the user has verified mutual alignment of both alignment steps.

A third independent alignment mentioned above speaks to motion of putter head 100 along horizontal axis 240 to center golf ball 130 on the striking face 200. In a properly balanced putter head, the rotational inertia about vertical 260 is large enough that no significant amount of rotation of striking face 200 occurs during impact to deflect golf ball 130 in an undesirable way if golf ball 130 is not struck in the middle of the striking surface 200. In other words, this alignment step is very forgiving and not a critical part of lining up a putt. It does, however, have a small effect on the forward energy imparted to the ball. The "sweet spot" on striking face 200 is the impact point which delivers the least angular torque to the golf club. In a proper swing, this spot will be near the center of mass of putter head 100.

Accordingly, it can be seen that proper use of the alignment procedures in conjunction with the alignment system signficantly improves the user's ability to accurately align the club face with the intended target. The user will experience an improvement in golf ability and performance because the alignment system provides the user with an on-axis view of the club, ball and target which eliminates alignment uncertainties and improves confidence. Other parallax correction techniques, such as the use of fans, shutters, prisms, or other devices such as those disclosed in U.S. patent application Ser. No. 08/489,546, filed on Jun. 12, 1995 and incorporated herein by reference, may also be implemented using techniques of the present invention.

Those skilled in the art, upon reading this disclosure, will recognize that the present invention may be embodied in other specific forms without departing from the spirit or essential characteristics thereof. Accordingly, the disclosure of the specific embodiments of the invention are intended to be illustrative, but not limiting, of the scope of the invention which is set forth in the following claims.

We claim:

1. A golf training kit for use with a golf club head having an open architecture, said club head having a top portion and a face portion, the kit comprising:

a removable training device having a base, said base formed to fit in a receiver formed in said club head; and a first removable plate formed to fit in said receiver when said removable training device is removed.

2. The training kit of claim 1, wherein said removable training device further includes means for securing to said club head.

3. The training kit of claim 1, wherein said removable training device is a parallax correction device.

4. The training kit of claim 1, wherein said training aid is a pointing device.

5. The training kit of claim 1, wherein said removable training aid is a view locator, comprising: comprising:

an imaging system; and a position grid;

said imaging system positioned a distance above said position grid to provide multi-dimensional position information to a user of said golf club.

6. The training kit of claim 1, further comprising at least a second removable plate, said first and second removable plates formed to have different masses selected to provide a selected swing weight for said club.

7. A golf club training system, the system comprising:

a golf club head having a top portion and a face portion;

an attachment location formed in said top portion of said golf club head;

at least a first removable training aid having an insert portion adapted to securely mate in said attachment location of said golf club head; and at least a first removable plate having an insert portion adapted to securely mate in said attachment location of said golf club head.

8. The system of claim 7 wherein said at least first removable training aid is a parallax alignment device.

9. The system of claim 7 wherein said at least first removable training aid is a pointing device creating a beam, said beam having a shape selected from the group consisting of a point, line, pattern, or plane.

10. The system of claim 8, wherein said parallax alignment device comprises:

a body member having a reflective layer, a transparent layer, and at least a first positioning line formed on a top surface of said transparent layer, said at least first positioning line formed to create at least a first image line substantially co-linear with said first positioning line when said face portion of said golf club head is properly aligned.

11. The system of claim 8, wherein said parallax alignment device comprises:

a body member having a reflective layer, a transparent layer, and a möire interferometry pattern formed on a top surface of said transparent layer, said möire interferometry pattern formed to create a discernable reflected pattern when said face portion of said golf club head is properly aligned.

12. The system of claim 8, wherein said parallax alignment device comprises:

a receiver in said insert portion having a multi-reflective cross section;

said receiver having a reflective surface;

a transparent fill layer deported in said receiver; and at least a first positioning line formed on a top surface of said transparent fill layer;

wherein said reflective surface causes at least a first image line to be formed substantially aligned with said at least first positioning line when said golf club head is properly aligned.

13. The system of claim 7, wherein said attachment location is an add-in retrofit piece adapted to couple to an existing golf club head.

14. The system of claim 7 further including at least a second removable plate having an insert portion adapted to securely mate in said attachment location of said golf club head, said first and second removable plates each having a different mass selected to alter a swing weight of said golf club head.

15. The system of claim 7 wherein said attachment location of said golf club head further includes a fastener device.

16. The system of claim 7 wherein said attachment location of said golf club head further includes a recess formed to receive a golf tee for removal of said removable plate and said removable training aid.

17. A removable device for aligning a face of a golf club with a target, said removable device comprising:

a base adapted to removably mate with said golf club;

a positioning device coupled to said base, said positioning device having a reflective layer and a substantially clear layer disposed above said reflective layer, said substantially clear layer having a thickness;

at least a first positioning line, positioned on a face surface of said substantially clear layer and spaced apart from said reflective layer by said thickness, said first positioning line reflecting from said reflective layer to form a first reflected line;

wherein said first positioning line and said first reflective line are substantially co-linear when parallax is eliminated.

18. The device of claim 17 wherein said device further comprises at least a second positioning line, positioned parallel to and apart from said first positioning line on said face surface of said substantially clear layer.

19. The device of claim 18 wherein said device further comprises a third positioning line, positioned parallel to and apart from said first and second positioning lines on said face surface of said substantially clear layer.

20. The device of claim 17 wherein said base is secured to said golf club with a removable attachment means.

* * * * *